US010794034B2

(12) United States Patent
Strand

(10) Patent No.: US 10,794,034 B2
(45) Date of Patent: Oct. 6, 2020

(54) ADAPTER FRAME

(71) Applicant: Sema Invest AS, Godvik (NO)

(72) Inventor: Eirik Strand, Rogn (NO)

(73) Assignee: Sema Invest AS, Godvik (NO)

( * ) Notice: Subject to any disclaimer, the term of this patent is extended or adjusted under 35 U.S.C. 154(b) by 302 days.

(21) Appl. No.: 16/066,035

(22) PCT Filed: Dec. 23, 2016

(86) PCT No.: PCT/NO2016/050269
§ 371 (c)(1),
(2) Date: Jun. 25, 2018

(87) PCT Pub. No.: WO2017/111615
PCT Pub. Date: Jun. 29, 2017

(65) Prior Publication Data

US 2020/0263381 A1 Aug. 20, 2020

(30) Foreign Application Priority Data

Dec. 23, 2015 (NO) ..... 20151788

(51) Int. Cl.
*E02D 5/00* (2006.01)
*E02D 29/14* (2006.01)
(Continued)

(52) U.S. Cl.
CPC ..... *E02D 29/1409* (2013.01); *E02D 29/149* (2013.01); *E02D 2450/00* (2013.01);
(Continued)

(58) Field of Classification Search
CPC ..... E02D 29/149; E02D 29/1409; E02D 2450/00; E03F 2003/065; E03F 2005/0413; E03F 5/02
(Continued)

(56) References Cited

U.S. PATENT DOCUMENTS 4,038,789 A * 8/1977 Axgarde ..... E02D 29/1409 52/20
6,109,824 A * 8/2000 Annes ..... E03F 5/0401 404/25
(Continued)

FOREIGN PATENT DOCUMENTS

EP 2096252 A1 9/2009
EP 2128344 A1 12/2009
(Continued)

OTHER PUBLICATIONS

Norwegian Search Report for Norwegian Patent Application No. 20151788, dated Jul. 23, 2016 (2 pages).
(Continued)

*Primary Examiner* — Raymond W Addie
(74) *Attorney, Agent, or Firm* — Nixon Peabody LLP

(57) ABSTRACT

An adapter frame for use when installing or renovating a basin in relation to a surface, the basin including a basin body with basin top, basin frame and basin cover. The adapter frame includes a skirt with an inward facing flange attached to an upper part of the skirt, an inner dimension of the flange being larger than a corresponding outer dimension of the basin frame and an inner dimension of at least a lower part of the skirt being larger than a corresponding outer dimension of the basin top. The adapter frame further includes a broad outward facing flange foot attached to a lower part of the skirt.

4 Claims, 6 Drawing Sheets

(51) Int. Cl.
*E03F 3/06* (2006.01)
*E03F 5/04* (2006.01)
*E03F 5/02* (2006.01)

(52) U.S. Cl.
CPC ..... *E03F 5/02* (2013.01); *E03F 2003/065* (2013.01); *E03F 2005/0413* (2013.01)

(58) Field of Classification Search
USPC ..... 404/25, 26; 52/19, 20
See application file for complete search history.

(56) References Cited

U.S. PATENT DOCUMENTS 6,161,984 A * 12/2000 Sinclair ..... E02D 29/1427 404/25
6,311,433 B1 * 11/2001 Zdroik ..... E02D 29/1409 404/26
6,851,225 B1 * 2/2005 Haar ..... E02D 29/1409 404/25
6,986,226 B2 * 1/2006 Banks ..... E02D 29/14 52/169.6
7,025,529 B2 * 4/2006 Boudreau ..... E02D 29/1409 404/25
7,150,580 B1 * 12/2006 Ess ..... E02D 29/12 404/26
7,770,333 B2 * 8/2010 Meyers ..... F16L 55/11 220/4.03
7,789,586 B2 * 9/2010 Ess ..... E02D 29/12 404/25
8,540,454 B2 * 9/2013 Lee ..... E02D 29/14 404/26
2008/0170908 A1 * 7/2008 Ess ..... E02D 29/12 404/25
2016/0108601 A1 4/2016 Strand

FOREIGN PATENT DOCUMENTS

FR 2941245 A1 7/2010
NO 20141252 A 4/2016

OTHER PUBLICATIONS

International Search Report and Written Opinion in International Patent Application No. PCT/NO2016/050269, dated Apr. 11, 2017 (9 pages).
International Preliminary Report on Patentability in International Patent Application No. PCT/NO2016/050269, dated Apr. 4, 2018 (6 pages).

* cited by examiner

ADAPTER FRAME

CROSS-REFERENCE TO RELATED APPLICATIONS

This application is a U.S. National Stage of International Application No. PCT/NO2016/050269, filed Dec. 23, 2016, which claims priority to and the benefit of Norwegian Application No. 20151788, filed Dec. 23, 2015, both of which are incorporated by reference in their entirety.

FIELD OF THE INVENTION

The present invention relates to a device for adjusting the elevation of a basin.

BACKGROUND

The expression basin includes ordinary basins for water, sewage and cables, as well as other shafts for servicing buried functions, and in particular basins that are arranged in a street, road or a square, the location being covered by asphalt, concrete or pavement slabs. A basin often includes a concrete basin body which is buried in the ground and connected to pipes or tunnels. Onto the top of the basin there is ordinarily placed a basin frame holding the cover. The basin frame is made from cast iron and the frame or road is adapted to provide the top of the frame being on a level with the road. When establishing new roads, settlements may occur in the road, resulting in the masses collapsing. The surface of the road may also elevate during winter due to frost in the upper ground layer, while the basin will stay put as it penetrates into the frost free sub-surface. This will create a height difference between the road and the basin, and will also break up the asphalt bordering the basin. The elevation of the basin must also be adjusted when the road is renewed with asphalt, e.g. by changing the basin frame or by adding shim-rings. There also exist basins wherein the basin frame protrudes into the underlying basin body, and thus may slide up and down into the basin in step with the road (floating basin frame).

EP 2 128 344 discloses a method of renovating a basin when new asphalt is added around the basin. The method includes lifting the basin frame from the top of the basin body, and cleaning the frame from rust and old asphalt. Then, a compressible gasket is placed around the basin frame. The basin frame is lowered into the basin with the gasket resting against the top of the basin body. A casting mixture is injected into the cavity between the frame and the surrounding asphalt, and the frame is lowered further into the correct position relative to the road. This is possible since the gasket is compressible and may be compressed as needed. The basin frame is the attached to the road's top coating, and may slide freely inside the top of the basin. The basin frame will float freely keeping in pace with the road raising and lowering.

Norwegian patent application 20141252, owned by the present applicant, describes a method for installing or renovating a basin in relation to a surface wherein a formwork ring is used between the basin body and the basin frame. The formwork ring is resting on the masses outside the basin top and is sealed against the basin frame with a gasket. This prevents the casting material from gluing the basin frame to the basin top, thus securing that the basin frame may move freely when the road is settling or moving in response to frost. As in EP 2128344, a casting mixture is fastening the basin to the upper layer of the asphalt.

Both solutions are regarded as excellent when adjusting basin frames that are lowered or are projecting too high relative to the road surface. Both solutions use a casting mixture in order to fasten the basin frame to the uppermost support layer (asphalt). When installing/renovating a basin, time is spent allowing the casting mixture to harden. When paving, this is regarded as time consuming and not practically feasible. Renovation of basin frames is a hectic process, in which a city street often is closed for some hours during the night while paving. Then, the basin frames must be renovated in quick succession as soon as the asphalt has been laid. Optionally, both solutions may be carried out previous to paving, but this raises other challenges. The basin frames may be installed with additional height corresponding to the thickness of the new asphalt layer. This thickness will vary according to where the basins are located in the road surface. It is therefore time consuming to adjust the basin frames, both in relation to each other and to the new asphalt layer arriving later on. In addition, basin frames which are installed or renovated with said methods cannot be readjusted without performing the full renovation process once more.

SUMMARY OF THE INVENTION

It is an object of the present invention to provide a device for use during installation or renovation of basin frames, wherein less casting mixture is used or no casting mixture at all, wherein the installation or renovation is faster to perform than prior art methods and which reduces the possibility of the basin frame sinking over time or becomes protruding.

This is achieved in an adapter frame as defined in the following patent claims.

In particular, the invention relates to an adapter frame for use when installing or renovating a basin in relation to a surface, wherein the basin includes a basin body with top, frame and cover, the adapter frame including a skirt with an inward facing flange fastened to the upper part of the skirt, the inner dimension of the flange being larger than the corresponding outer dimension of the basin frame and an inner dimension of at least the lower part of the skirt being larger than a corresponding outer dimension of the basin top. Furthermore, a broad outward facing flange foot is fastened to a lower end of the skirt.

The object of this construction is to transfer the weight of the basin frame, the cover and external loads down to the gravel lying around the basin body, i.e. below the road surface. The basin frame may then be adjusted vertically by adding or removing asphalt. Then it is avoided having to cast the basin frame to the road's top coating with casting mixtures. Furthermore, the possibility of crushing extension rings located at the top of the basin body is avoided, as the load is transferred from the basin body to the gravel surrounding the basin top.

By transferring the load from the surface to the gravel below, low cost asphalt may fully or at least partially replace the costly casting mixtures used in prior art solutions. Asphalt will harden very quickly, it will not stick hard to the basin frame and may thus easily be cleaned from the basin frame when renovating a basin, and may be used more than once, all unlike standard casting mixtures.

The adapter frame may also include a gasket fastened to the inner circumference of the flange. This gasket prevents asphalt from penetrating between the adapter frame and basin frame.

Said skirt on the adapter frame may be cylindrical. This may allow some movement between the adapter frame and the basin body.

The skirt may be provided with reinforcement ribs. Such ribs may be necessary to strengthen the frame against external loads.

The outward facing flange foot may be perpendicular or inclined relative to the skirt.

BRIEF DESCRIPTION OF THE DRAWINGS

Subsequently, the invention will be described in detail in reference to the appended drawings, in which.

DETAILED DESCRIPTION

Figure 1:
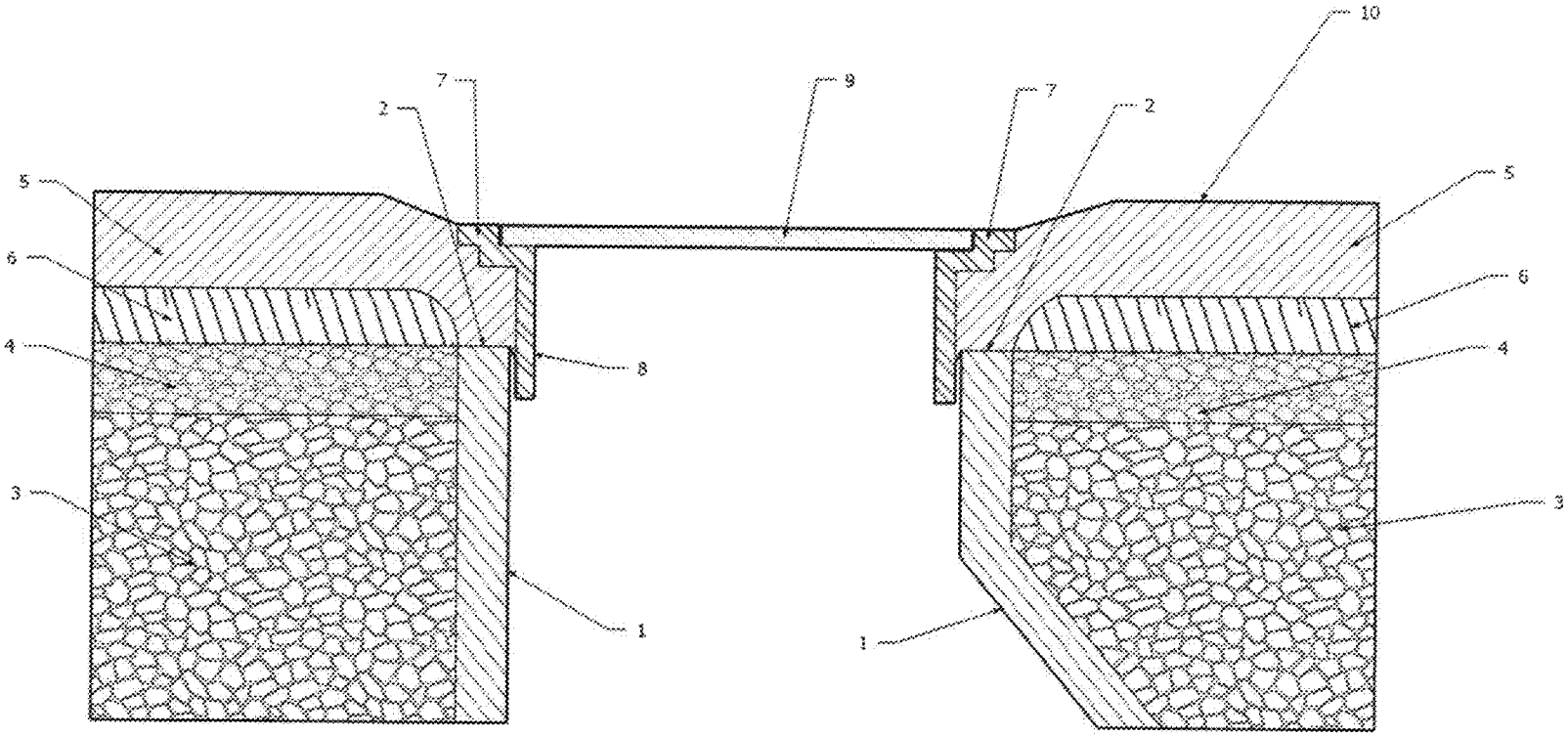
FIG. 1 shows a prior art basin, wherein the height of the basin frame should be adjusted.

FIG. 1 shows a basin with a body 1 and top 2, which is installed in the ground. Above the ground 3, a layer of draining gravel 4 is filled. Onto the gravel 4 a road with layers of asphalt 5 and substrate 6 is established. A basin frame 7 with flange 8 and cover 9 is running through the upper layers 5 and 6. The basin frame is fastened to the upper layers, but is intended to slide freely inside the basin body 1, i.e. the basin frame is of the floating variety. This will not always work as intended. In case the road surface is lifted, e.g. due to frost, a void will be created (above the basin top/basin body which is lying on ground without frost), whereupon the load on the frame (from traffic) will press the basin frame into the void and thus create unevenness between the road surface and basin frame. In this case, the basin frame has sunk and has to be elevated to come into a correct level relative to the road surface 10. Masses may also enter the void adjacent to the basin frame and thus avoiding sagging. In this way the frame will project above the road surface when the ground frost is thawing.

Figure 2:
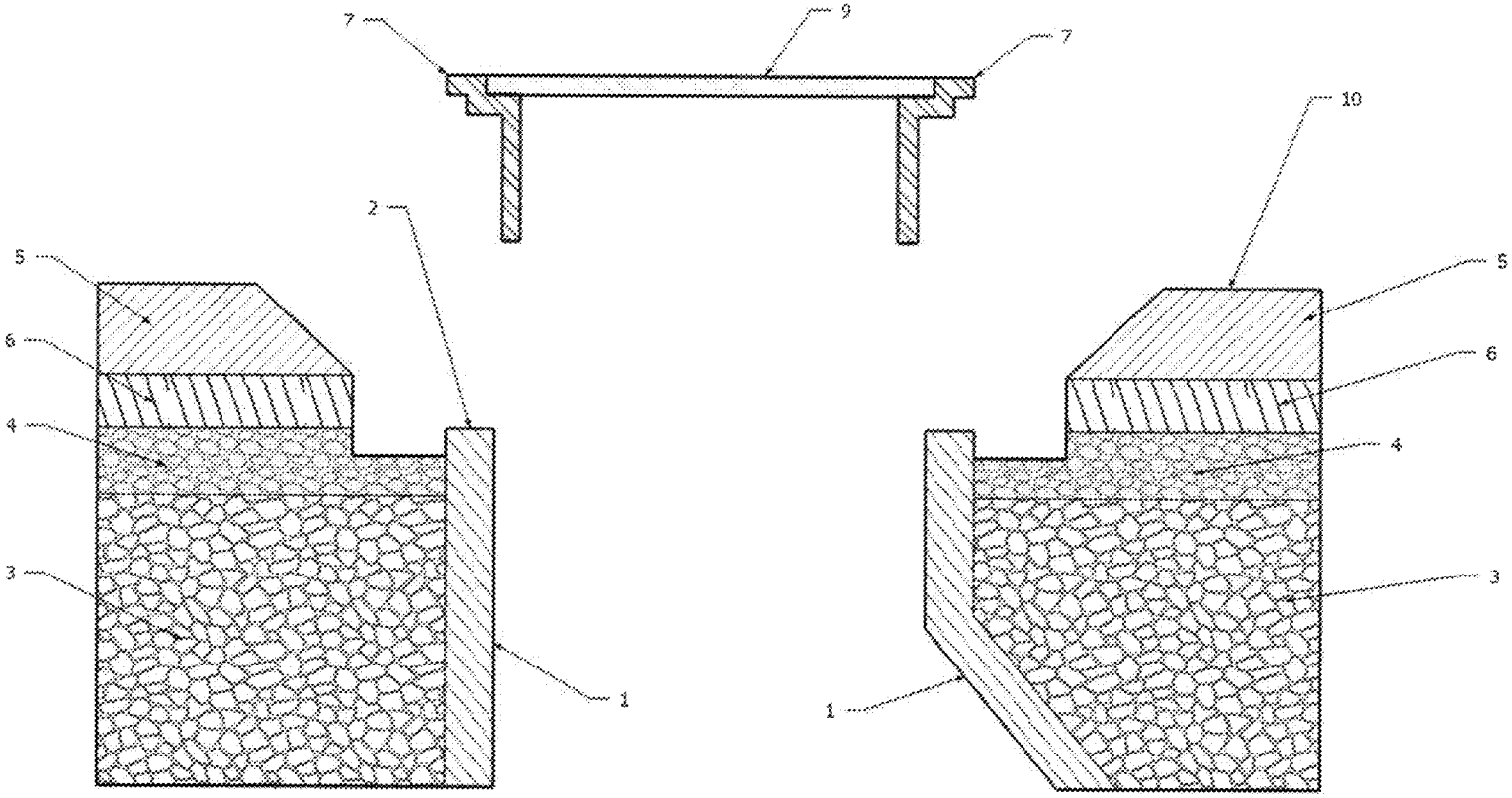
FIG. 2 illustrates a first step in renovating the basin.

FIG. 2 shows the same basin. The basin frame is now removed and cleaned from old asphalt and rust. The edge of the opening in the road surface is aligned and prepared for installation of the adapter frame 11 and reinstallation of the basin frame.

Figure 3:
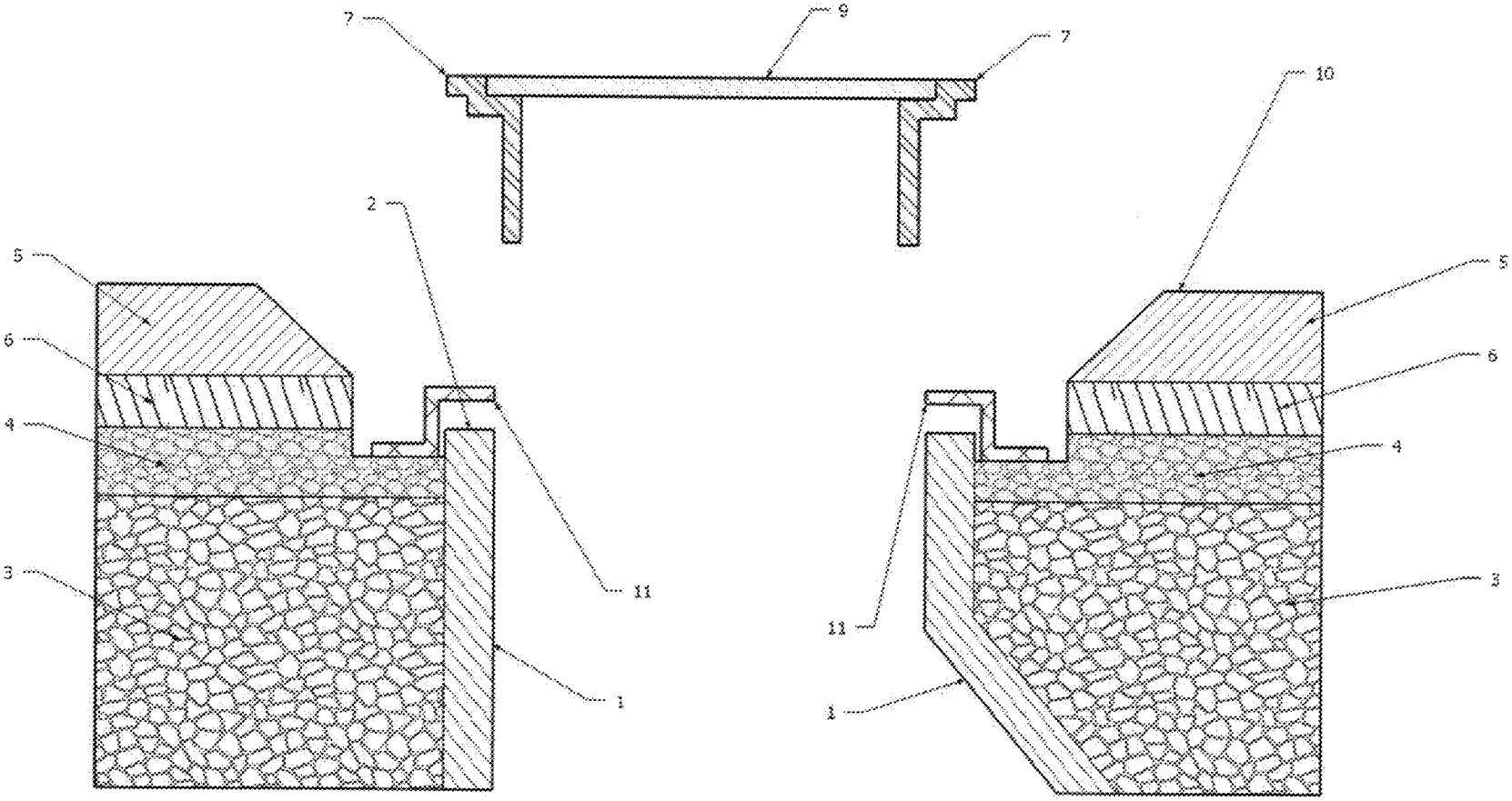
FIG. 3 shows the next step, with the installation of a device according to the invention.

FIG. 3 shows that a device, an adapter frame 11 is lowered in the opening. The adapter frame 11 rests on the gravel outside the basin body.

Figure 4:
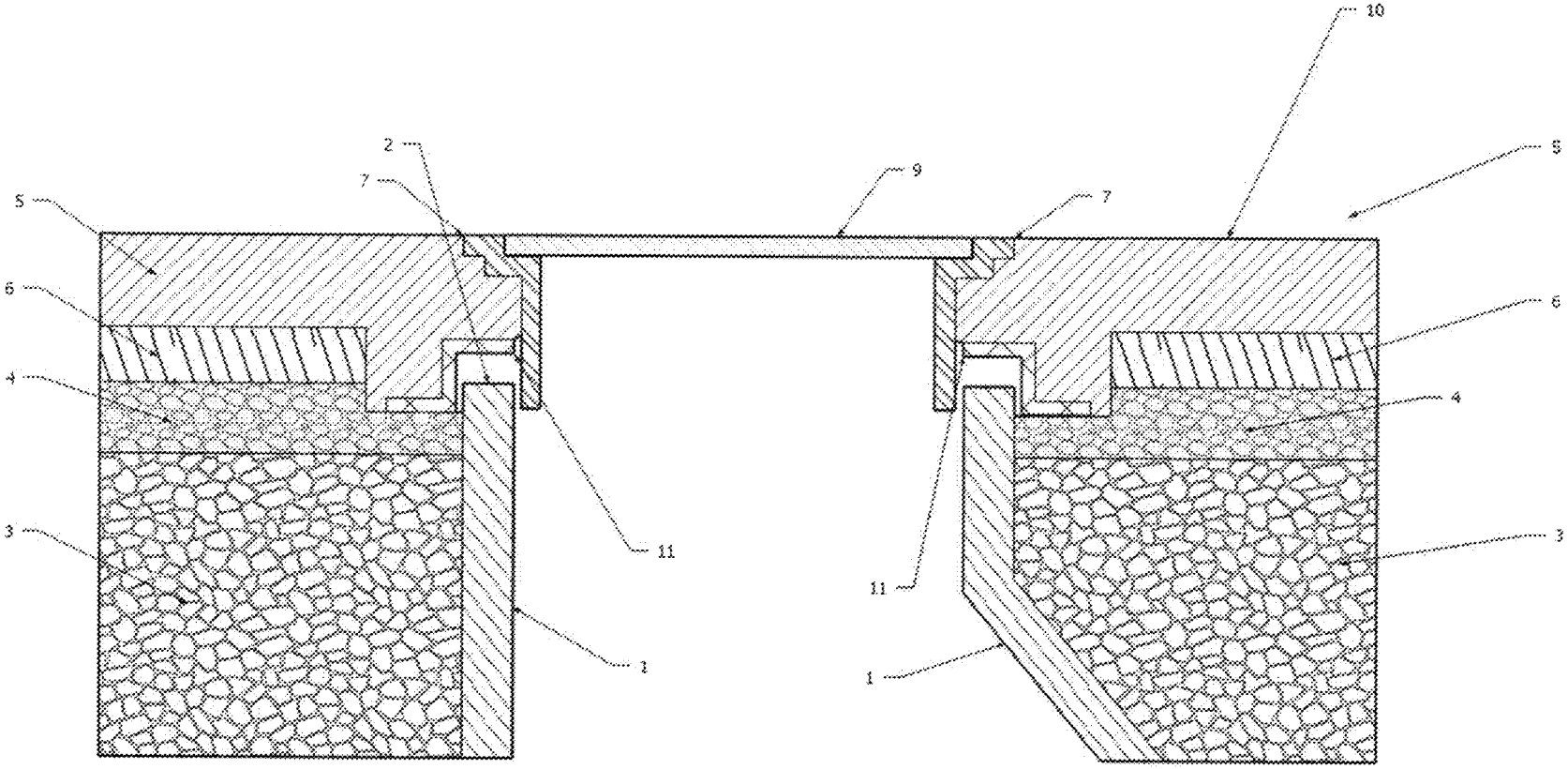
FIG. 4 shows the final step when reinstalling the basin frame at correct height.

In FIG. 4 the basin frame is lowered into the opening and adjusted into a correct level relative to the road surface. A dedicated tool or machinery is used for this task (not shown). The position of the basin frame in the basin body is controlled by the adapter frame 11. Tarmac mass 5 is laid into the cavity outside the basin ring, while the basin frame is being held at the correct level. The adapter frame will prevent the asphalt mass from contacting the lower parts of the frame, thus preventing the mass from adhering to the frame in the area where it enters the basin body. An important difference from prior art techniques is that the basin frame no longer transfers the load from above via the asphalt mass down to the basin top, but that the forces applied to the basin frame instead are transferred via the asphalt mass to the adapter frame, and from there to the gravel outside the basin body. The void between the basin top and the adapter frame will absorb possible movements between the basin frame and top.

Figure 5A:
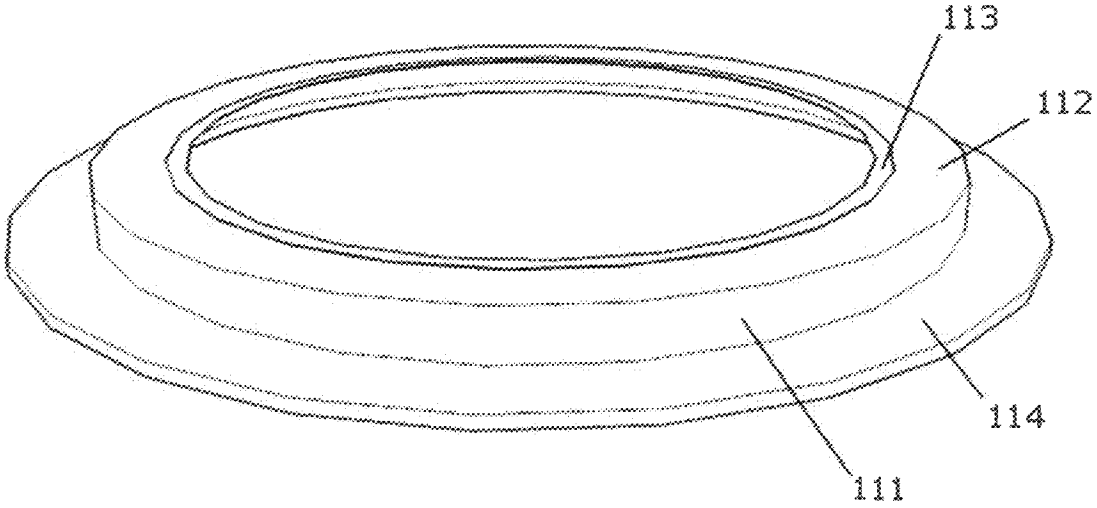
FIG. 5*a-b* shows possible embodiments of a device according to the invention.

FIG. 5*a* shows a possible embodiment of the adapter frame 11. The adapter frame includes a skirt 111, an inward facing flange 112 which is attached to an upper end of the skirt 111, an optional gasket 113 attached to the inner circumference of the flange 112, and an outward facing flange foot 114 attached to the lower part of the skirt 111. The gasket may be loose and only pressed onto the flange 112. The object of the gasket is to prevent asphalt from protruding between the basin frame and adapter frame into the cavity inside the adapter frame. The adapter frame must be dimensioned such that it will lie external to or outside the basin top, the flange foot resting on the masses outside the basin top. The adapter frame may be cylindrical in shape and may be produced in dimensions fitting standard basins, i.e. the adapter frame fitting tightly around the circumference of the basin top. The adapter frame may be assembled from several parts or cast in one piece. The adapter frame may also be without any gasket, in case it fits tightly enough around the basin body.

Figure 5B:
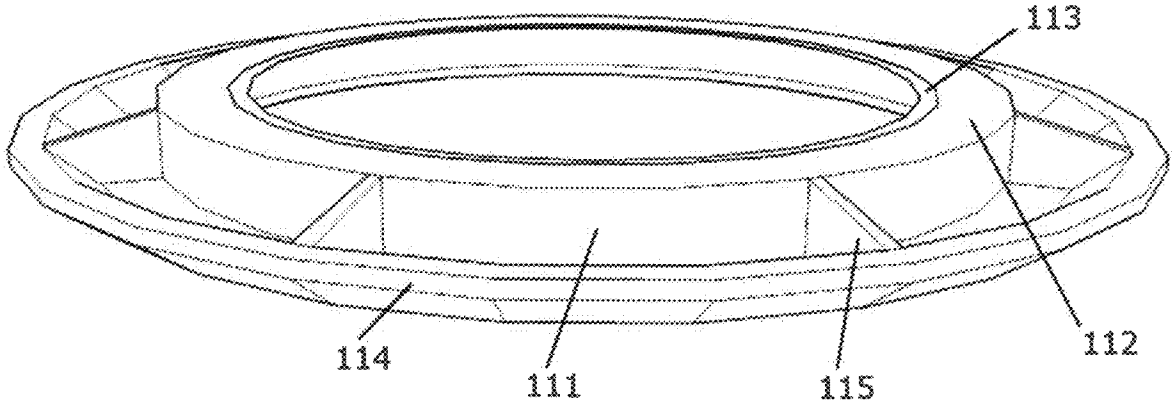

FIG. 5*b* shows another embodiment of the adapter frame, where flange-foot is fully or partially inclined relative to the skirt in order to provide a larger support surface. The adapter frame is exposed to large loads, and may therefore be provided with reinforcements in the form of ribs 115 on the inside.

The adapter frame may be of miscellaneous shapes, i.e. shaped as a circular ring, or a square or rectangular ring, or any other shape fitting the appearance of the basin top and frame.

The invention claimed is:

1. An adapter frame for use when installing or renovating a basin, the basin including a basin body buried in the ground, with a basin top, a basin frame adapted to be on level with a top coating covering the ground, the basin frame being of the floating type and holding a basin cover, wherein the adapter frame is placed between the basin body and the basin frame preventing the basin frame from being attached to the basin body, the adapter frame forming a void between the basin top and the adapter frame, wherein the adapter frame includes a skirt with an inward facing flange attached to an upper part of the skirt, the flange fitting around the circumference of the basin frame and an inner dimension of at least a lower part of the skirt being larger than a corresponding outer dimension of the basin top, characterized in an outward facing flange foot attached to a lower part of the skirt, the flange foot resting on masses outside the basin body transferring forces from the basin frame to the masses outside the basin body.

2. An adapter frame according to claim 1, further including a gasket attached to an inner circumference of the flange.

3. An adapter frame according to claim 1, wherein the flange foot projects perpendicular from the skirt.

4. An adapter frame according to claim 1, wherein the flange foot is inclined relative the skirt, and is provided with ribs.

* * * * *